US010249947B1

(12) United States Patent
Chun

(10) Patent No.: US 10,249,947 B1
(45) Date of Patent: Apr. 2, 2019

(54) MULTI-MODE CONDUCTIVE LIQUID ANTENNA

(71) Applicant: SPAWAR Systems Center Pacific, San Diego, CA (US)

(72) Inventor: Tyler Fujio Mun Cheong Chun, Aiea, HI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 62 days.

(21) Appl. No.: 15/718,553

(22) Filed: Sep. 28, 2017

(51) Int. Cl.
*H01Q 1/36* (2006.01)
*H01Q 3/01* (2006.01)

(52) U.S. Cl.
CPC ..... *H01Q 3/01* (2013.01); *H01Q 1/362* (2013.01)

(58) Field of Classification Search
CPC ..... H01Q 3/01; H01Q 1/362
See application file for complete search history.

(56) References Cited

U.S. PATENT DOCUMENTS 4,800,395 A * 1/1989 Balzano ..... H01Q 1/362 343/749
5,349,362 A * 9/1994 Forbes ..... H01Q 1/42 343/701
7,969,370 B1 6/2011 Dinh et al.
8,797,221 B2 8/2014 Cetiner et al.
2010/0095762 A1* 4/2010 Despesse ..... H01Q 1/243 73/290 V

FOREIGN PATENT DOCUMENTS

GB 2436166 A * 9/2007 ..... H01Q 9/40
GB 2436168 A * 9/2007 ..... H01Q 9/30

OTHER PUBLICATIONS

Zhou, Yun et al.; A Liquid Metal Conical Helical Antenna for Circular Polarization-Reconfigurable Antenna; Hindawi Publishing, vol. 2016, Article 3782373; 2016.

(Continued)

*Primary Examiner* — Hoang V Nguyen
*Assistant Examiner* — Jae K Kim
(74) *Attorney, Agent, or Firm* — SPAWAR Systems Center Pacific; Kyle Eppele; J. Eric Anderson

(57) ABSTRACT

A multi-mode antenna comprising: a liquid that is electrically conductive; a nonconductive, straight tube designed to contain the conductive liquid, wherein the straight tube has a top end and a bottom end; a helical coil comprised of non-conductive tubing designed to contain the conductive liquid wherein the helical coil tubing has a top end and a bottom end; and a pump fluidically coupled to the bottom ends of the straight tube and the helical coil, wherein the pump is configured to pump the conductive liquid between the straight tube and the helical coil, such that when the conductive liquid fills the straight tube and the helical coil tubing is drained, the multi-mode antenna functions as a monopole antenna, and such that when the conductive liquid fills the helical coil tubing and the straight tube is drained, the multi-mode antenna functions as a helical antenna.

20 Claims, 8 Drawing Sheets

(56) References Cited

OTHER PUBLICATIONS

Mazlouman, Shahrzad Jalali et al.;A Reconfigurable Patch Antenna Using Liquid Metal Embedded in a Silicone Substrate; IEEE Transactions on Antennas and Propagation, Vol. 59, No. 12, Dec. 2011.
Khan, Mohammad et al.; A Frequency shifting liquid metal antenna with pressure responsiveness; Appl. Phys. Lett. 99, 013501 (2011).
Rodrigo et al.; Circular Beam-Steering Reconfigurable Antenna With Liquid Metal Parasitics; IEEE Transactions on Antennas and Propagation, vol. 60, No. 4, Apr. 2012.
Haapala, Paivi et al.; Dual Frequency Helical Antennas for Handsets; IEEE, 1996.

* cited by examiner

MULTI-MODE CONDUCTIVE LIQUID ANTENNA

FEDERALLY-SPONSORED RESEARCH AND DEVELOPMENT

The United States Government has ownership rights in this invention. Licensing and technical inquiries may be directed to the Office of Research and Technical Applications, Space and Naval Warfare Systems Center, Pacific, Code 72120, San Diego, Calif., 92152; voice (619) 553-5118; ssc_pac_t2@navy.mil. Reference Navy Case Number 103063.

BACKGROUND OF THE INVENTION

This invention relates to the field of reconfigurable radio frequency (RF) antennas. There have been previous attempts to provide a reconfigurable RF antenna, but these previous attempts faced challenges that limited the performance of the prior reconfigurable antennas. There is a need for an improved reconfigurable RF antenna.

SUMMARY

Disclosed herein is a multi-mode antenna comprising an electrically-conductive liquid, a nonconductive, straight tube, a helical coil, and a pump. The nonconductive, straight tube is designed to contain the conductive liquid. The straight tube has a top end and a bottom end. The helical coil is comprised of non-conductive tubing designed to contain the conductive liquid. The helical coil tubing also has a top end and a bottom end. The pump is fluidically coupled to the bottom ends of the straight tube and the helical coil. The pump is configured to pump the conductive liquid between the straight tube and the helical coil such that when the conductive liquid fills the straight tube and the helical coil tubing is drained, the multi-mode antenna functions as a monopole antenna. When the conductive liquid fills the helical coil tubing and the straight tube is drained, the multi-mode antenna functions as a helical antenna.

The multi-mode antenna disclosed herein may be provided by first providing a conductive liquid. The next step provides for fluidically coupling a straight, nonconductive tube to a helical coil comprised of nonconductive tubing. The next step provides for filling either the helical coil or the straight tube with the conductive liquid. The next step provides for configuring a pump to transfer the conductive liquid between the helical coil and the straight tube. The next step provides for feeding the conductive liquid with a radio frequency (RF) signal such that the multi-mode antenna functions as a helical antenna when the conductive liquid is in the helical coil and as a monopole antenna when the conducive liquid is in the straight tube.

An embodiment of the multi-mode antenna disclosed herein may be described as comprising an electrically conductive liquid, a nonconductive mass of material, and a pump. The mass of nonconductive material has internal liquid channels capable of containing the liquid. One of the internal liquid channels is a straight, vertical channel, and another internal liquid channel is in the shape of a helical coil. In this embodiment, the straight channel is disposed along a center axis of the helical coil. The pump is fluidically coupled to the straight channel and to the helical coil. The pump is configured to pump the liquid between the straight channel and the helical coil channel such that when the liquid fills the straight channel and the helical coil channel is drained, the multi-mode antenna functions as a monopole antenna. When the conductive liquid fills the helical coil channel and the straight channel is drained, the multi-mode antenna functions as a helical antenna.

BRIEF DESCRIPTION OF THE DRAWINGS

Throughout the several views, like elements are referenced using like references. The elements in the figures are not drawn to scale and some dimensions are exaggerated for clarity.

DETAILED DESCRIPTION OF EMBODIMENTS

The disclosed multi-mode antenna and method below may be described generally, as well as in terms of specific examples and/or specific embodiments. For instances where references are made to detailed examples and/or embodiments, it should be appreciated that any of the underlying principles described are not to be limited to a single embodiment, but may be expanded for use with any of the other methods and systems described herein as will be understood by one of ordinary skill in the art unless otherwise stated specifically.

Figure 1A:
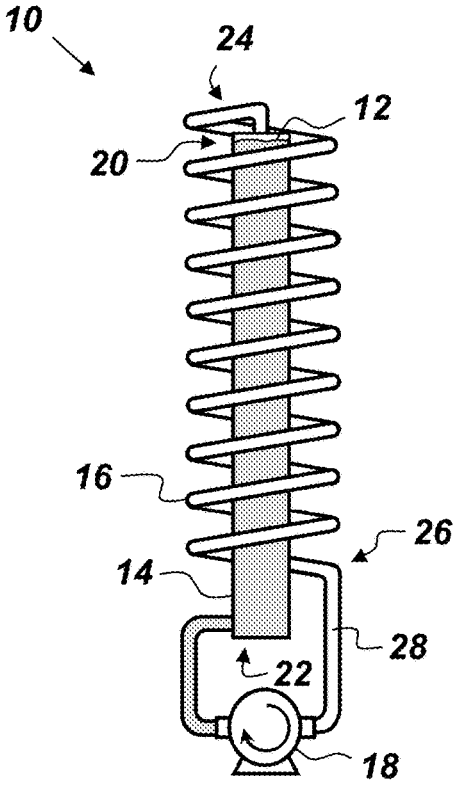
FIGS. 1A and 1B are side-view illustrations of different modes of an embodiment of a multi-mode antenna.
Figure 1B:
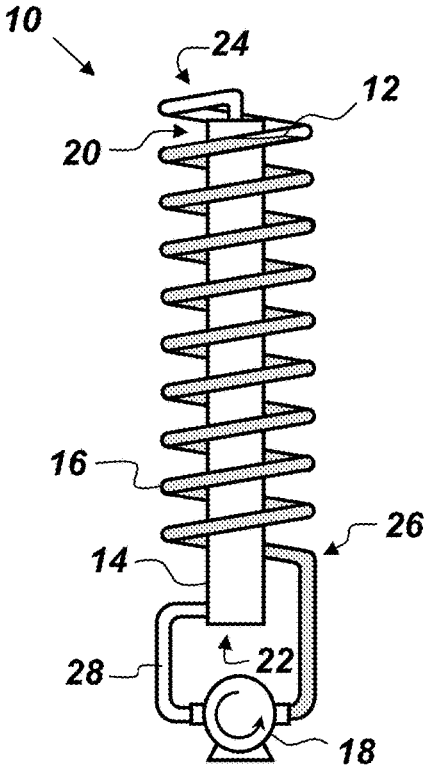

FIGS. 1A and 1B are side-view illustrations of an embodiment of a multi-mode antenna 10 that comprises, consists of, or consists essentially of an electrically-conductive liquid 12, a straight tube 14, a helical coil 16, and a pump 18. The multi-mode antenna 10 has the ability to switch modes of operation between different antenna types (i.e., helical and monopole). Thus, the properties of the electromagnetic (EM) radiation emitted by the multi-mode antenna 10 may be changed as needed by switching between the helical and monopole modes of operation. FIG. 1A shows an embodiment of the multi-mode antenna 10 in a monopole antenna configuration. FIG. 1B shows the same embodiment of the multi-mode antenna 10 in a helical antenna configuration. The straight tube 14 is designed to contain the conductive liquid 12. The straight tube 14 has a top end 20 and a bottom end 22. The helical coil 16 is comprised of non-conductive tubing designed to contain the conductive liquid 12. In FIGS. 1A and 1B, the straight tube 14 and the helical coil 16 are depicted as being transparent to enable the viewing of the conductive fluid 12 inside the antenna 10. However, it is to be understood that the helical coil 16 and the straight tube 14 are not limited to transparent tubing, but may be any tubing that is nonconductive and capable of containing the conductive fluid 12. The tubing of the helical coil 16 also has a top end 24 and a bottom end 26. The pump 18 is fluidically coupled to the bottom end 22 of the straight tube 14 and the bottom end 26 of the helical coil 16. The pump 18 is configured to pump the conductive liquid 12 between the straight tube 14 and the helical coil 16 such that when the conductive liquid 12 fills the straight tube 14 and the helical coil 16 is drained (such as is depicted in FIG. 1A), the multi-mode antenna 10 functions as a monopole antenna. When the conductive liquid 12 fills the helical coil 16 and the straight tube 14 is drained (such as is depicted in FIG. 1B), the multi-mode antenna 10 functions as a helical antenna. In the embodiment of the antenna 10 shown in FIGS. 1A and 1B, the direction in which the pump 18 pumps the conductive liquid 12 may be reversed to toggle between the monopole antenna configuration and the helical antenna configuration.

In the embodiment of a multi-mode antenna 10 shown in FIGS. 1A and 1B the straight tube 14 and the helical coil 16 have internal volumes that are substantially equivalent such that both the straight tube 14 and the helical coil 16 are both capable of containing the same given volume of conductive liquid 12. Also, in the embodiment of a multi-mode antenna 10 shown in FIGS. 1A and 1B, the top end 20 of the straight tube 14 and the top end 24 of the helical coil 16 are fluidically coupled such that an internal gas 28 inside the straight tube 14 and the helical coil 16 may pass between the helical coil 16 and the straight tube 14 through the top ends 20 and 24 as the conductive liquid 12 is being transferred between the straight tube 14 and the helical coil 16. The internal gas 28 may be any gas that is nonreactive with the conductive liquid 12. Suitable examples of the internal gas 28 include, but are not limited to, air and nitrogen. The multi-mode antenna 10 is not dependent on physical deformation of the straight tube 14 or the helical coil 16 to change its properties. The beam pattern and the polarization of the multi-mode antenna 10 may be changed by altering the amount of conductive liquid 12 that is pumped into either the straight tube 14 and/or the helical coil 16.

The conductive liquid 12 may be any liquid that is electrically conductive. Suitable examples of the conductive liquid 12 include, but are not limited to, liquid mercury, salt water, sea water, ionic fluids, liquid gallium, liquid gallium aluminum alloy, liquid sodium potassium alloy, and sulfuric acid.

The straight tube 14 and the helical coil 16 may be made of any conductive tubing cable of containing the conductive liquid 12. The straight tube 14 and the helical coil 16 may be flexible or rigid and may have any desired cross-section (e.g., rectangular, circular, oval, star-shaped, etc.). The straight tube 14 and the helical coil 16 need not have the same properties. The straight tube 14 and the helical coil 16 may be transparent, translucent, or opaque. Suitable materials from which the straight tube 14 and the helical coil 16 may be made include, but are not limited to, glass, rubber, and synthetic polymers.

The pump 18 may be any pump capable of pumping the conductive liquid 12 into the straight tube 14 and/or the helical coil 16. Suitable examples of the pump 18 include, but are not limited to, a syringe pump, a peristaltic pump, a variable displacement pump, a gear pump, and a lobe pump. In the embodiment of the antenna 10 shown in FIGS. 1A and 1B, the pump 18 is reversible in that it can pump the conductive liquid 12 from the straight tube 14 into the helical coil 16 or vice versa.

Figure 2:
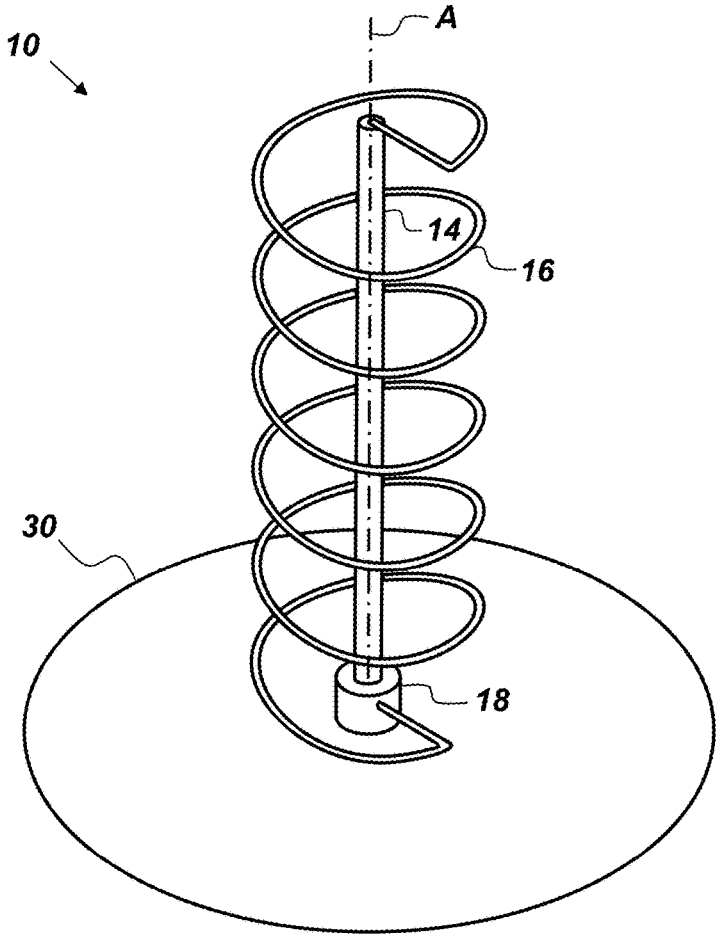
FIG. 2 is a perspective-view illustration of an embodiment of a multi-mode antenna.

FIG. 2 is a perspective view of an embodiment of the antenna 10. In this embodiment, the antenna 10 further comprises a ground 30, which may be made of any conductive material. Also in this embodiment, the straight tube 14 is disposed along a center axis A of the helical coil 16, both of which are self-supporting. Both the beam pattern and polarization of the multi-mode antenna 10 will change depending on the mode of operation. For example, when the multi-mode antenna 10 is operating as a helical antenna the beam pattern is directive long the axis A of the helical coil 16 and the polarization is elliptical. When the multi-mode antenna 10 is operating in monopole mode the beam pattern is omni-directional in the azimuth plane, which is parallel to the ground 30 shown in FIG. 2, and the polarization is linear.

Figure 3:
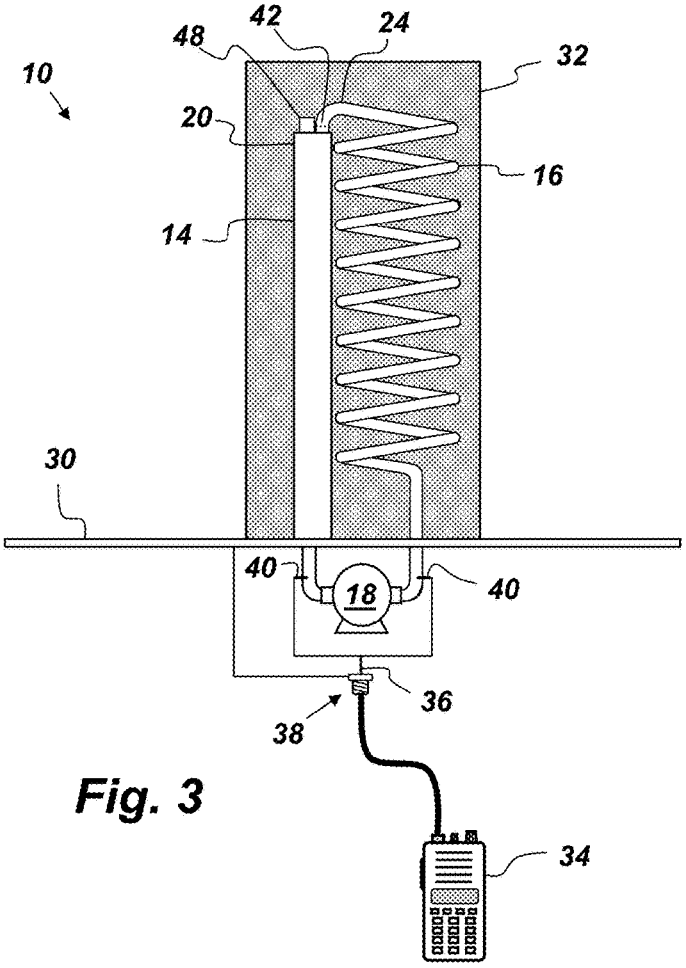
FIG. 3 is a side-view illustration of an embodiment of a multi-mode antenna.

FIG. 3 is a side-view illustration of an embodiment of the antenna 10 where the straight tube 14 and the helical coil 16 are supported by a support structure 32 that is designed to hold the helical coil 16 and the straight tube 14 in a non-co-axial position. The support structure 32 may be made of any nonconductive material. For example, the support structure 32 may be made of hardened foam. FIG. 3 also shows one way in which the antenna 10 may be connected to a transceiver 34. In this embodiment a center pin 36 of a coaxial radio frequency (RF) connector 38 is electrically connected to conductive pins 40 that penetrate into the straight tube 14 and the helical coil 16 such that the conductive pins 40 feed either the monopole antenna configuration or the helical antenna configuration of the antenna 10 depending on whether the conductive liquid 12 is located in the straight tube 14 or the helical coil 16 respectively. The RF connector 38 is grounded to the ground 30. FIG. 3 also shows an optional membrane 42 placed between the top ends 20 and 24 of the straight tube 14 and the helical coil 16. The membrane 42 is a semi-permeable membrane designed to allow internal gas to pass there through and to impede the passage of the conductive liquid 12. The embodiment of the multi-mode antenna 10 shown in FIG. 3 also comprises a conductive liquid sensor 48 mounted near the top ends 20 and 24 of the straight tube 14 and the helical coil 16.

Figure 4:
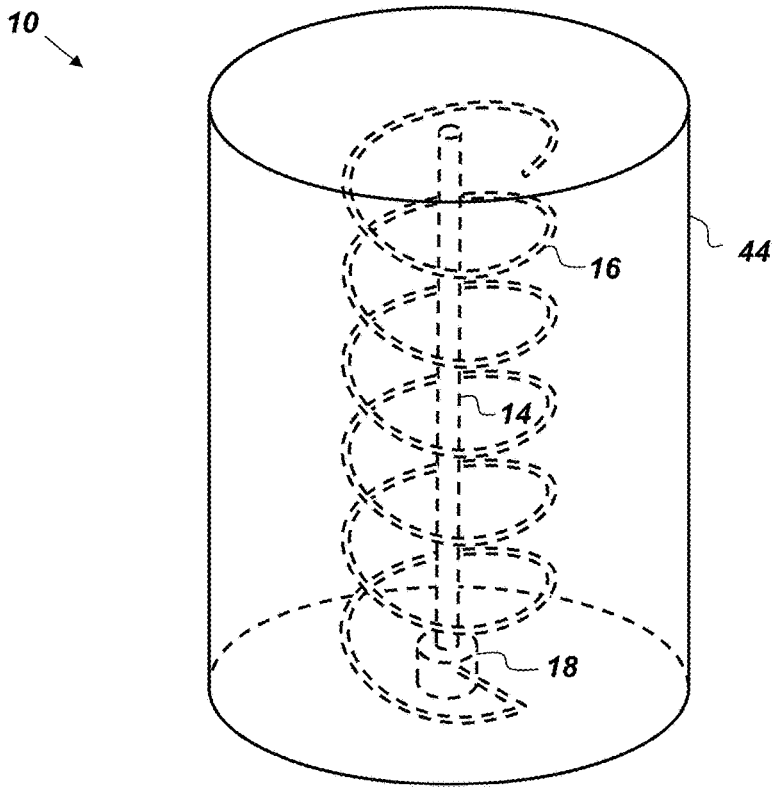
FIG. 4 is a perspective-view illustration of an embodiment of a multi-mode antenna.

FIG. 4 is a perspective view of an embodiment of the multi-mode antenna 10 where the straight tube 14 and the helical coil 16 are channels formed out of a single mass of synthetic polymer 44. The mass of synthetic polymer 44 and the internal channels that form the straight tube 14 and the helical coil 16 may be constructed through additive manufacturing processes or other manufacturing processes that are known in the art. In this embodiment of the multi-mode antenna 10 (i.e., the embodiment shown in FIG. 4), the top end 20 of the straight tube 14 and the top end 24 of the helical coil 16 are sealed such that the top ends 20 and 24 are not fluidically coupled. In this embodiment, there is no fluid transfer between the top ends 20 and 24 of the straight tube 14 and the helical coil 16. Thus, as conductive liquid 12 is pumped into either the straight tube 14 or the helical coil 16 any internal gas that is in the straight tube 14 or the helical coil 16 gets compressed. Alternatively, the straight tube 14 and the helical coil 16 may be partially evacuated before being filled with the conductive liquid 12.

Figure 5A:
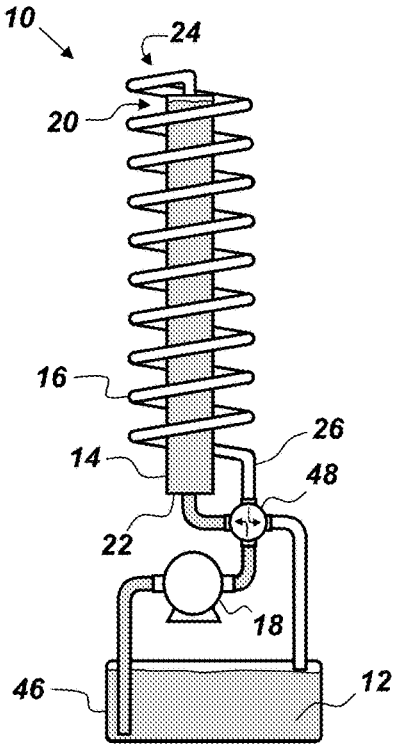
FIGS. 5A and 5B are side-view illustrations of different modes of an embodiment of a multi-mode antenna.
Figure 5B:
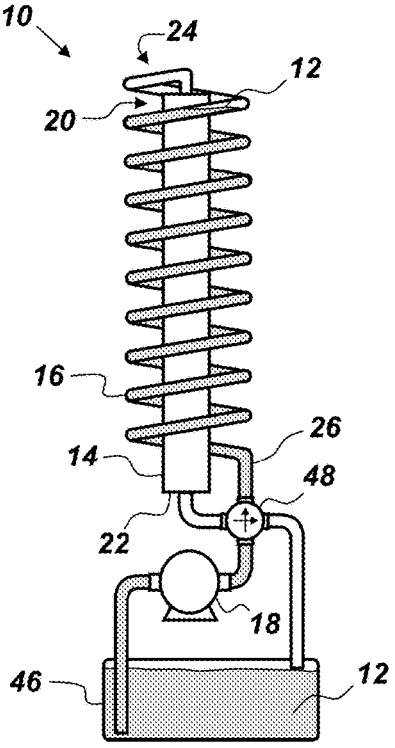

FIGS. 5A and 5B are side-view illustrations of an embodiment of the multi-mode antenna 10 that comprises a liquid reservoir 46 that is fluidically coupled to the pump 18 so as to serve as a source of conductive liquid 12. Whether the conductive liquid 12 is pumped into the straight tube 14 or the helical coil 16 is determined by the position of a switch 48. When the switch 48 is in a first position, such as is shown in FIG. 5A, the pump 18 pumps conductive liquid 12 into the straight tube 14 and any conductive liquid 12 in the helical coil 16 drains into the liquid reservoir 46. When the switch 48 is in a second position, such as is shown in FIG. 5B, the pump 18 pumps conductive liquid 12 into the helical coil 16 and any conductive liquid 12 in the straight tube 14 drains into the liquid reservoir 46. With the embodiment of the multi-mode antenna 10 shown in FIGS. 5A and 5B the operating frequency of the monopole antenna configuration may be altered by varying the height of the conductive liquid 12 in the straight tube 14. The pump 18 and the switch 46 may be manually controlled, or they may be automatically controlled by a logic circuit.

Figure 6:
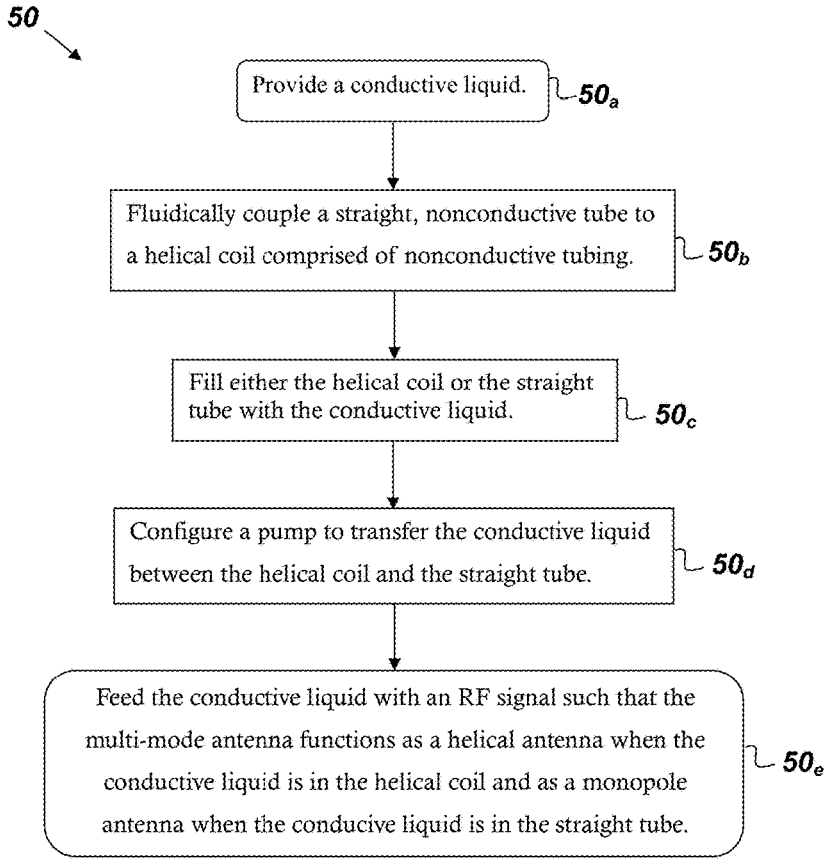
FIG. 6 is a flowchart of a method for providing a multi-mode antenna.

FIG. 6 is a flowchart of a method 50 for providing an embodiment of the multi-mode antenna 10 comprising the following steps. The first step $\mathbf{50}_a$ involves providing a conductive liquid. The next step $\mathbf{50}_b$ provides for fluidically coupling a straight, nonconductive tube to a helical coil comprised of nonconductive tubing. The next step $\mathbf{50}_c$ provides for filling either the helical coil or the straight tube with the conductive liquid. The next step $\mathbf{50}_d$ provides for configuring a pump to transfer the conductive liquid between the helical coil and the straight tube. The next step $\mathbf{50}_e$ provides for feeding the conductive liquid with an RF signal such that the multi-mode antenna functions as a helical antenna when the conductive liquid is in the helical coil and as a monopole antenna when the conducive liquid is in the straight tube.

The multi-mode antenna 10 may switch between modes in a plurality of ways. For example, in one example embodiment (such as is shown in FIGS. 1A and 1B) the pump 18 is an electric pump and switching the polarity of power to the pump 18 causes the pump 18 to reverse pumping direction. The pump 18 may be shut off after a predetermined amount of time after it is turned on or reversed. The predetermined amount of time may be calculated to ensure that the pump 18 pumps long enough to fill either the straight tube 14 or the helical coil 16 to a desired height. In another example embodiment, such as is shown in FIG. 4, the pump may be set to shut off automatically based on increased resistance to pumping due to the conductive liquid 12 having filled either the helical coil 16 or the straight tube 14 or due to the sensor 48 detecting the conductive liquid near the top ends 20 and 24 of the straight tube 14 or the helical coil 16.

The multi-mode antenna 10 may be configured to change modes automatically depending on the frequency/type of signal that is desired to be received/transmitted. The multi-mode antenna 10 has applications in ground-mobile, expeditionary and many different operations. The multi-mode antenna 10 can provide users with the flexibility to communicate and collect signals with directive or non-directive antenna configurations with increased frequency agility and in a self-contained, non-hazardous package. The multi-mode antenna 10 has applicability to lighten-the-load of hand-held radio users, ground vehicles, and can potentially be used to reduce the number and type of antennas on ship masts. The multi-mode antenna 10 changes the structure of the antenna itself by moving the conductive liquid between the straight tube 14 and the helical coil 16. This eliminates the need for numerous switches and reduces unwanted parasitic effects from floating components/conductors. Further, the operating frequency of the multi-mode antenna 10 may be altered by varying the temperature of the multi-mode antenna 10, which in turn causes the conductive liquid 12 to expand or contract. The degree of temperature increase or decrease may be controlled by a processor.

Figure 7:
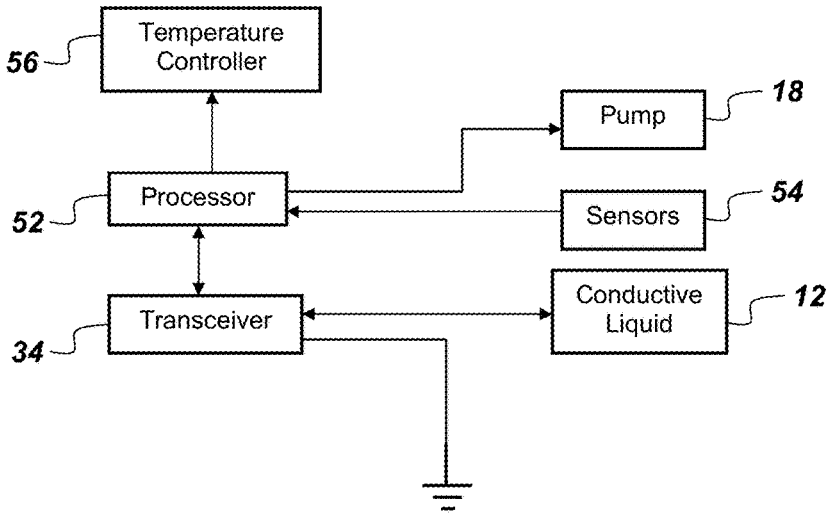
FIG. 7 is a schematic of electrical connections of an embodiment of a multi-mode antenna.

FIG. 7 is a schematic showing electrical connections of an embodiment of the multi-mode antenna 10. In this embodiment a processor 52 is operatively coupled to the pump 18, sensors 54, and a temperature controller 56. The sensors 54 may comprise any desired sensors such as the liquid sensor 48, a temperature sensor, an accelerometer, etc. The temperature controller 56 may be a resistive heater, a cooling fan, or any other means for altering the temperature of an object as is known in the art.

Figure 8:
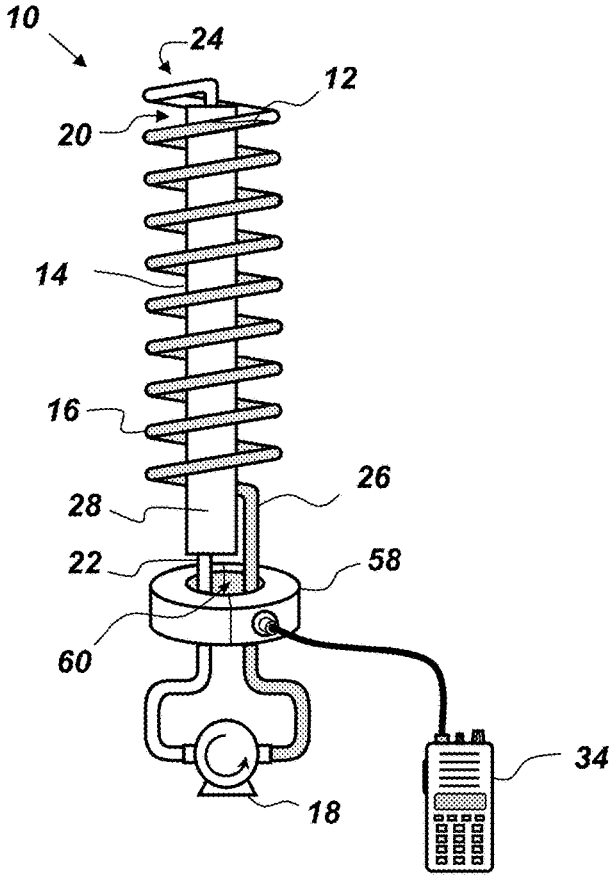
FIG. 8 is a side-view illustration of an embodiment of a multi-mode antenna.

FIG. 8 is a side-view illustration of an embodiment of the multi-mode antenna 10 in its helical antenna configuration. In the embodiment of the multi-mode antenna 10 shown in FIG. 8, the antenna is fed with a current probe 58, which is connected to the transceiver 34. The current probe 58 may be any device capable of feeding the multi-mode antenna 10 via magnetic induction without coming into physical contact with the conductive liquid 12. The current probe 58 has a shape that is topologically equivalent to a toroid having a central hole 60 therein. Portions of the bottom ends 22 and 26 of the straight tube 14 and the helical coil 16 are disposed within the central hole 60. A suitable example of the current probe 58 is the current injection device disclosed in U.S. Pat. No. 6,492,956 to Fischer et al., which is incorporated herein by reference. The current probe 58 may have a solid, ferromagnetic, toroidal core or the core may be split into two or more sections to allow it to be clamped around the bottom ends 22 and 26 of the straight tube 14 and the helical coil 16 without coming into physical contact with the conductive liquid 12.

From the above description of the multi-mode antenna 10, it is manifest that various techniques may be used for implementing the concepts of the multi-mode antenna 10 without departing from the scope of the claims. The described embodiments are to be considered in all respects as illustrative and not restrictive. The method/apparatus disclosed herein may be practiced in the absence of any element that is not specifically claimed and/or disclosed herein. It should also be understood that the multi-mode antenna 10 is not limited to the particular embodiments described herein, but is capable of many embodiments without departing from the scope of the claims.

I claim:

1. A multi-mode antenna comprising:

a liquid that is electrically conductive;

a nonconductive, straight tube designed to contain the conductive liquid, wherein the straight tube has a top end and a bottom end;

a helical coil comprised of non-conductive tubing designed to contain the conductive liquid wherein the helical coil tubing has a top end and a bottom end; and a pump fluidically coupled to the bottom ends of the straight tube and the helical coil, wherein the pump is configured to pump the conductive liquid between the straight tube and the helical coil, such that when the conductive liquid fills the straight tube and the helical coil tubing is drained, the multi-mode antenna functions as a monopole antenna, and such that when the conductive liquid fills the helical coil tubing and the straight tube is drained, the multi-mode antenna functions as a helical antenna.

2. The multi-mode antenna of claim 1, wherein the straight tube and the helical coil have equal internal volumes.

3. The multi-mode antenna of claim 1, wherein the conductive liquid is liquid metal.

4. The multi-mode antenna of claim 1, wherein the straight tube and the helical coil are comprised of tubing having a circular cross-section.

5. The multi-mode antenna of claim 1, further comprising a support structure designed to hold the helical coil and straight tube in position.

6. The multi-mode antenna of claim 1, wherein the straight tube and the helical coil tubing are channels formed out of a single mass of synthetic polymer.

7. The multi-mode antenna of claim 1, wherein the top ends of the straight tube and the helical coil are sealed such that there is no fluid transfer between the top ends of the straight tube and the helical coil.

8. The multi-mode antenna of claim 2, wherein the top ends of the straight tube and the helical coil tubing are fluidically coupled such that as liquid is pumped into the bottom end of the straight tube, expelled gas exiting the top end of the straight tube enters the top end of the helical coil and vice versa.

9. The multi-mode antenna of claim 8, further comprising a semi-permeable membrane positioned between the top ends of the straight tube and the helical coil, wherein the semi-permeable membrane is designed to allow gas to pass therethrough and to impede the passage of the liquid.

10. The multi-mode antenna of claim 1, further comprising a liquid reservoir fluidically coupled to the pump so as to serve as a source of liquid for pumping into at least one of the straight tube and the helical coil and to receive the liquid when pumped out of the straight tube or the helical coil.

11. The multi-mode antenna of claim 1, wherein the straight tube is disposed along a center axis of the helical coil.

12. The multi-mode antenna of claim 1 wherein the pump is reversible such that the pump is configured to pump the conductive liquid in one of two directions.

13. The multi-mode antenna of claim 12, further comprising a switch connected to the pump such that when the switch is in a first position the pump pumps the liquid into the straight tube and when the switch is in a second position the pump pumps the liquid into the helical coil.

14. A method for providing a multi-mode antenna comprising the following steps:

providing a conductive liquid;

fluidically coupling a straight, nonconductive tube to a helical coil comprised of nonconductive tubing;

filling either the helical coil or the straight tube with the conductive liquid;

configuring a pump to transfer the conductive liquid between the helical coil and the straight tube;

feeding the conductive liquid with a radio frequency (RF) signal such that the multi-mode antenna functions as a helical antenna when the conductive liquid is in the helical coil and as a monopole antenna when the conducive liquid is in the straight tube.

15. The method of claim 14, wherein the pump is an electric pump and switching the polarity of power to the pump causes the pump to reverse pumping direction.

16. The method of claim 15, further comprising the steps of:

switching from a helical mode to a monopole mode by toggling a switch from a first position into a second position, whereby the pump transfers the conductive liquid from the helical coil into the straight tube; and switching from the monopole mode to the helical mode by toggling the switch from the second position into the first position, whereby the pump transfers the conductive liquid from the straight tube into the helical coil.

17. The method of claim 16, further comprising a step of shutting the pump off after a predetermined amount of time after the switch is toggled.

18. The method of claim 16, further comprising a step of shutting the pump off after the switch is toggled upon receiving input from a sensor.

19. The method of claim 16, wherein the pump shuts off automatically based on increased resistance to pumping due to the conductive liquid having filled either the helical coil or the straight tube.

20. A multi-mode antenna comprising:

a liquid that is electrically conductive;

a mass of nonconductive material having internal liquid channels capable of containing the liquid, wherein one of the internal liquid channels is a straight, vertical channel, and another internal liquid channel is in the shape of a helical coil wherein the straight channel is disposed along a center axis of the helical coil; and a pump fluidically coupled to the straight channel and the helical coil, wherein the pump is configured to pump the liquid between the straight channel and the helical coil channel, such that when the liquid fills the straight channel and the helical coil channel is drained, the multi-mode antenna functions as a monopole antenna, and such that when the conductive liquid fills the helical coil channel and the straight channel is drained, the multi-mode antenna functions as a helical antenna.

* * * * *